US006610976B2

(12) United States Patent
Chait et al.

(10) Patent No.: US 6,610,976 B2
(45) Date of Patent: Aug. 26, 2003

(54) METHOD AND APPARATUS FOR IMPROVED SIGNAL-TO-NOISE RATIO IN MASS SPECTROMETRY

(75) Inventors: Brian T. Chait, New York, NY (US); Andrew N. Krutchinsky, New York, NY (US)

(73) Assignee: The Rockefeller University, New York, NY (US)

( * ) Notice: Subject to any disclaimer, the term of this patent is extended or adjusted under 35 U.S.C. 154(b) by 0 days.

(21) Appl. No.: 10/232,100

(22) Filed: Aug. 28, 2002

(65) Prior Publication Data

US 2003/0042413 A1 Mar. 6, 2003

Related U.S. Application Data

(60) Provisional application No. 60/315,462, filed on Aug. 28, 2001.

(51) Int. Cl.[7] ..... H01J 49/00

(52) U.S. Cl. ..... 250/281; 230/282; 230/283; 230/284; 230/285; 230/286; 230/287; 230/288

(58) Field of Search ..... 250/281–300; 435/173

(56) References Cited

U.S. PATENT DOCUMENTS 5,696,376 A * 12/1997 Doroshenko et al. ..... 250/292
6,339,218 B1 * 1/2002 Kato et al. ..... 250/288
2002/0148972 A1 * 10/2002 Krutchinsky et al. ... 250/396 R

OTHER PUBLICATIONS

Gygi,S.P.; Aebersold, R. *Curr Opin Chem Biol*2000, 4, 489–494.

Chalmers, M.J.; Gaskell, S.J. *Curr Opin Biotechnol*2000, 11, 384–390.

Krutchinsky, A.N.; Zhang, Zhang, Wenzhu, and Chait, Brian T. "Rapidly Switchable Matrix–Assisted Laser Desorption/Ionization and Electrospray Quandrupole–Time–of–Flight Mass Spectrometry for Protein Indentification", *J Am Soc Mass Spectrom*2000, 11, 493–504.

Krutchinsky, A.N.; Kalkum, M.; Chait, B.T. "Automatic Identification of Proteins with a MALDI–Quadrupole Ion Trap Mass Spectrometer", *Anal Chem*2001, 74, 5066–5077.

Livadaris, V.; Blais, J.–C.; Tabet, J–C. *Eur. J. Mass Spectrom.* 2000, 6, 409–413.

Ramsey, R.S.; Goeringer, D. E.; McLuckey, S.A. *Anal Chem*1993, 65, 3521–3524.

Mordehai, A. V.; J. D. Henion *Rapid Commun. Mass Spectrom*1993, 7, 1131–1135.

Aebi, B.; Henion, J *Rapid Commun. Mass Spectrom.* 1996, 10, 947–951.

Voyksner, R. D.; Lee H. *Rapid Commun Mass Spectrom*1999, 13, 1427–1437.

(List continued on next page.)

*Primary Examiner*—John R. Lee
*Assistant Examiner*—James P. Hughes
(74) *Attorney, Agent, or Firm*—Irving N. Feit; Hoffmann & Baron, LLP

(57) ABSTRACT

A method and apparatus for increasing the signal-to-noise ratio in a range of mass-to-charge ratios of a mass spectrum. Initially ions of interest and background ions having mass-to-charge ratios within the range of mass-to-charge ratios are generated. The ions of interest and the background ions are then subjected to an activation energy sufficient to cause dissociation of background ions to an extent greater than the dissociation of the ions of interest. The dissociation of the background ions causes the background ions to have mass-to-charge ratios that fall outside of the range of mass-to-charge ratios. The mass-to-charge ratios of the ions of interest are then detected.

47 Claims, 8 Drawing Sheets

OTHER PUBLICATIONS

Guevremont, R.; Barnett, D.A.; Purves, R.W.; Vandermey, J. *Anal Chem*, 2000, 72, 4577–4584.
Karas M, Gluckmann M, Schafer J. *Mass Spectrom*2000, 35, 1–12.
Keller, B.O.; Li,L. *J. Am.Soc. Mass Spectrom*. 2000, 11, 88–93.
Schwartz, J.C.; Wade, A.P.; Enke, C.G.; Cooks, R.G. *Anal Chem*1990, 62, 1809–1818.
Thomson, B.A.; Chernushevich, I.V. *Rapid Commun Mass Spectrom*1998, 12, 1323–1329.
Wells, M.J.; Cooks, G.R *Rapid Commun Mas Spectrom*1999, 13, 752–754.

* cited by examiner 1 fmol
2 sec
Relative Abundance
100
0
1673.1
1347.3
905.1
1955.0
2933.6
3493.9
500
1000
1500
2000
2500
3000
3500
4000

1 fmol
5 sec
pELYENKPRRPYIL
y 9 8 7 6
b 8 9 11 12
Relative Abundance
100
0
1655.9
b13
1654.9
y5
661.2
y7
914.4
b8
1012.5
y8
1042.4
y9
1156.6
b9
1168.4
y10
1286.0
b11
1428.5
b12
1541.7
1673.1
500
700
900
1100
1300
1500
1700

0.1 fmol
1 min
MS/MS m/z 1673
Relative Abundance
100
0
860.0
772.0
1097.7
1937.1
2635.2
3109.4
3603.0
389.5
500
1000
1500
2000
2500
3000
3500
4000

0.1 fmol
1 min
Relative Abundance
100
0
1655.1
Δ136.0
Δ154.8
Δ154.6
Δ136.2
Δ135.3
Δ136.8
y9
b9
y5
y7
y8
661.3
914.3
1042.8
1156.7
1168.6
1265.0
1382.5
1400.3
1518.5
1537.1
1673.3
500
700
900
1100
1300
1500
1700
m/z

METHOD AND APPARATUS FOR IMPROVED SIGNAL-TO-NOISE RATIO IN MASS SPECTROMETRY

This application claims priority to U.S. Provisional Patent Application Serial No. 60/315,462, filed Aug. 28, 2001, which is incorporated herein by reference.

STATEMENT OF GOVERNMENT RIGHTS

This invention was made with Government support by the National Institute of Health (Grant RR00862 from the National Center for Research Resources and grant R33CA89810 from the National Cancer Institute). The Government has certain rights in the invention.

BACKGROUND OF THE INVENTION

The present invention relates generally to a method and apparatus for improved signal-to-noise ratios in mass spectrometry. The present invention is primarily directed to dissociating background ions for reducing chemical noise.

Developments in mass spectrometry (MS) technology over the past two decades have led to astonishing improvements in the sensitivity for peptide analysis. Gygi, S. P.; Aebersold, R. *Curr Opin Chem Biol* 2000, 4, 489–494; Chalmers, M. J.; Gaskell, S. J. *Curr Opin Biotechnol* 2000, 11, 384–390; Papac, D. I.; Shahrokh, Z.; *Pharm Res* 2001, 8, 131–145. This success is attributable to the introduction and refinement of matrix-assisted laser desorption ionization (MALDI) and electrospray ionization (ESI), enhancements of the efficiency and performance of mass analyzers, improvements in spectral analysis tools, as well as optimization of sample handling techniques. These developments have advanced MS to the level of a tool of choice for protein identification and characterization.

Currently, the practical limit in sensitivity is usually imposed by background ions in the mass spectrum rather than the inherent sensitivity of the mass spectrometer. For example, inspection of mass spectra obtained in the inventors' MALDI/ESI-QqTOF and MALDI/ESI-ion trap instruments (Krutchinsky, A. N.; Zhang, W.; Chait, B. T. *J Am Soc Mass Spectrom* 2000, 11, 493–504; Krutchinsky, A. N.; Kalkum, M.; Chait, B. T. "Rapid, Automatic Identification of proteins With a Novel MALDI-Ion Trap Mass Spectrometer" accepted for publication in *Anal. Chem.*) reveal background ion peaks at essentially every m/z value. Close examination of these individual background peaks indicates the presence of a large number of different ion species at each m/z value. Although the presence of this "chemical noise" is widely recognized and numerous attempts have been made to reduce its effect, its nature and origin is presently unknown. Livadaris, V.; Blais, J. -C.; Tabet, J-C. *Eur. J. Mass Spectrom.* 2000, 6, 409–413; Ramsey, R. S.; Goeringer, D. E.; McLuckey, S. A. *Anal Chem* 1993, 65, 3521–3524; Mordehai, A. V.; J. D. Henion *Rapid Commun. Mass Spectrom* 1993, 7, 1131–1135; Aebi, B.; Henion, J *Rapid Commun. Mass Spectrom.* 1996, 10, 947–951; Voyksner, R. D.; Lee H. *Rapid Commun Mass Spectrom* 1999, 13, 1427–1437; Guevremont, R.; Barnett, D. A.; Purves, R. W.; Vandermey, J. *Anal Chem,* 2000, 72, 4577–4584; Karas M, Gluckmann M, Schafer J. *J Mass Spectrom* 2000, 35, 1–12; Keller, B. O.; Li, L. J. *Am. Soc. Mass Spectrom.* 2000, 11, 88–93.

When the magnitude of the signal from analyte ions becomes comparable to that of background ions, the ion peaks of interest begin to merge with the noise and can no longer be distinguished unless special accommodations are made to increase the signal-to-noise ratio. One approach is to accumulate the spectra for longer times. However, the statistical improvement of the signal-to-noise increases rather slowly with accumulation time, and the increased time for MS analysis quickly leads to the problem of premature consumption of the sample before the full analysis can be completed. This problem is especially true for multiple MS/MS measurements of the components of peptide mixtures. Another approach for overcoming the noise limitation utilizes linked scan modes of operation. Schwartz, J. C.; Wade, A. P.; Enke, C. G.; Cooks, R. G. *Anal Chem* 1990, 62, 1809–1818; Thomson, B. A.; Chernushevich, I. V. *Rapid Commun Mass Spectrom* 1998, 12, 1323–1329; Wells, M. J.; Cooks, G. R *Rapid Commun Mass Spectrom* 1999, 13, 752–754. Unfortunately, current realizations of this technique have low efficiency due to the low duty cycle incurred by the necessity to scan the mass spectrometer. Although selective MS/MS analysis of the ions of interest can greatly improve the duty cycle, the m/z ratio of the ion to be fragmented may be unknown.

Accordingly there is a need for reducing chemical noise in MS experimentation.

SUMMARY OF THE INVENTION

In one embodiment, the invention relates to a method for increasing the signal-to-noise ratio in a range of mass-to-charge ratios of a mass spectrum. The method comprises generating ions of interest and background ions having mass-to-charge ratios within the range of mass-to-charge ratios. The ions of interest and the background ions are then subjected to an activation energy sufficient to cause dissociation of background ions to an extent greater than the dissociation of the ions of interest. The dissociation of the background ions causes the background ions to have mass-to-charge ratios that fall outside of the range of mass-to-charge ratios. The mass-to-charge ratios of the ions of interest are then detected.

In another embodiment, the present invention relates to an improved mass spectrometer. The mass spectrometer comprises a source of ions of interest and background ions, a mass-to-charge analyzer, and a means to transport the ions from the source to the analyzer. The mass spectrometer produces a mass spectrum of signals representing the ions of interest and the background ions in a selected range of mass-to-charge ratios. The improvement relates to providing the mass spectrometer with a means to subject the ions of interest and the background ions to an activation energy sufficient to cause dissociation of background ions to an extent greater than the dissociation of the ions of interest. The dissociation of the background ions causes the background ions to have mass-to-charge ratios that fall outside of the range of selected mass-to-charge ratios which increases the ratio of signal-to-noise in the selected range of mass-to-charge ratios.

BRIEF DESCRIPTION OF THE DRAWINGS

Preferred embodiments of the invention have been chosen for purposes of illustration and description and are shown in the accompanying drawings, wherein.

DETAILED DESCRIPTION OF THE INVENTION

Figure 1:
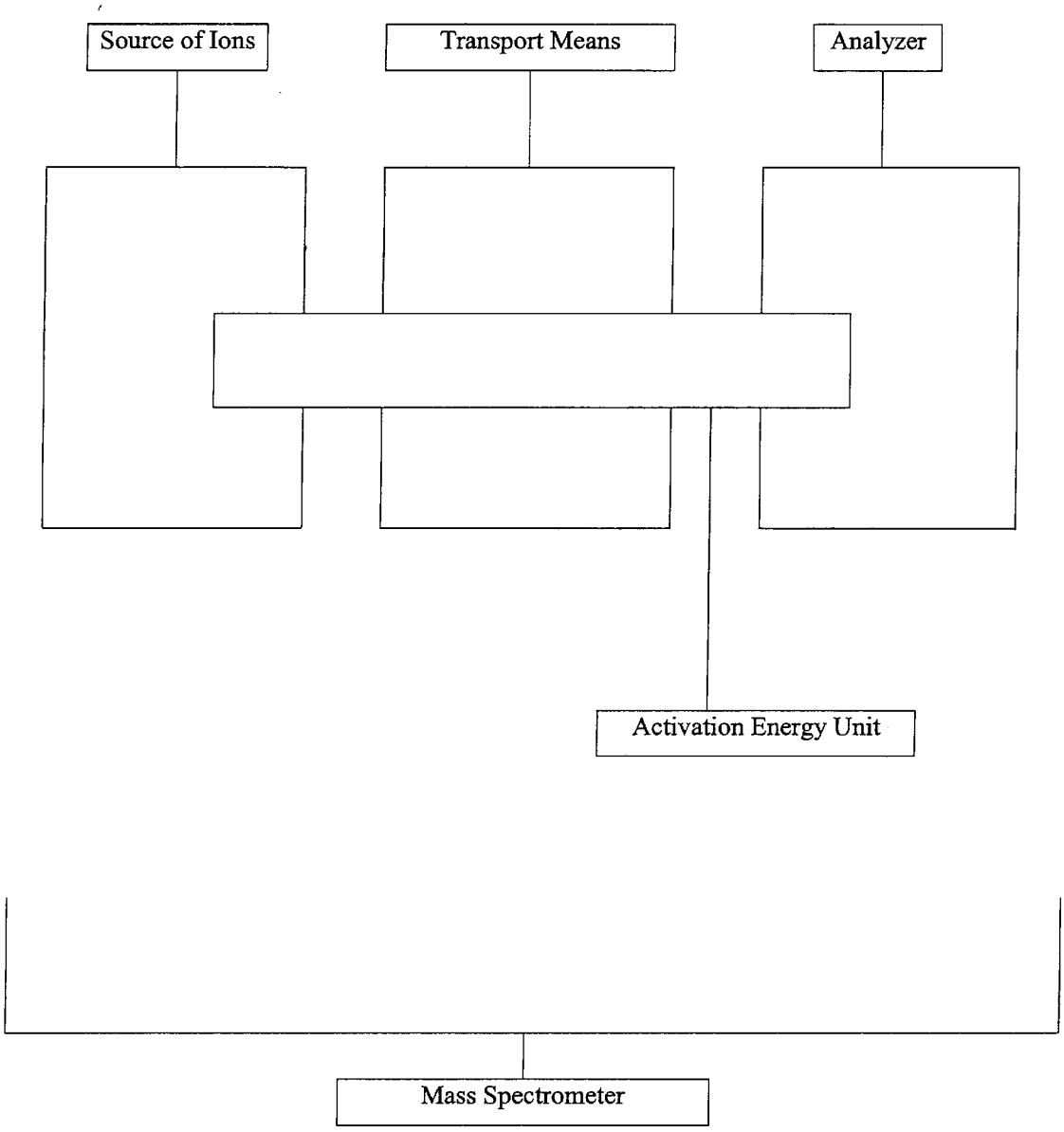
FIG. 1 is schematic representation of a mass spectrometer in accordance with the present invention.

The present invention is based on the discovery by the inventors that at least one source of chemical noise in mass spectrometers are "clusters ions" caused by the ionization of molecules present in the medium in which an analyte is ionized. The cluster ions are the background ions that contribute to the chemical noise in a mass spectrum.

The inventors have also discovered that a significant portion of cluster ions dissociates at activation energies lower than the threshold for peptide ion fragmentation. Therefore, at an appropriate activation energy, the background ions dissociate to an extent greater than the dissociation, if any, of the ions of interest.

In one embodiment, the invention is directed to a method for increasing signal-to-noise ratios in a range of mass-to-charge ratios (m/z) of a mass spectrum of an analyte. The analyte may be any molecule of interest that has at least one covalent bond. Typical analytes include organic molecules and biological molecules, such as polyamino acids (oligopeptides, polypeptides, peptides, and proteins) and nucleic acid molecules (oligonucleotides, polynucleotides, e.g. DNA and RNA).

The method comprises generating ions of interest by ionizing the analyte, and selecting a range of mass-to-charge ratios. Inadvertently, background ions having mass-to-charge ratios within the selected range are also generated.

The range of m/z values depends on numerous operating factors. Typical factors include, for example, the particular application of mass spectroscopy, the analytes, and the ions generated. The minimum m/z ratio in the range may, for example, be approximately 1, 10, 30, or 50. The maximum m/z ratio in the range may, for example, be approximately 100, 200, 500, 1,000, 4000, or 100,000.

The analyte is typically situated in a medium and ionized from the medium. The choice of medium, in turn, depends mainly on the choice of the type of ion source, e.g. MALDI, ESI, etc., used to ionize the analyte in the mass spectrometer.

In a MALDI ion source, for example, the medium in which the analyte is ionized is a matrix. Some typical matrices comprise one or more of 2,5-dihydrobenzoic acid, α-cyano-4-hydroxycinnamic acid, and 3,5-dimethoxy-4-hydroxycinnamic acid.

In an ESI source, as another example, the medium is a solvent. Some typical solvents comprise one or more of water, acetic acid, trifluoroacetic acid, formic acid, acetonitrile and methanol.

A significant component of the background ions are ionized clusters of molecules that are components of the medium. The molecules are typically held together, at least in part, by non-covalent bonds and/or relatively weak covalent bonds. The ionized clusters dissociate by eliminating one or more of the molecules composing the clusters.

The ions of interest and the background ions are subjected to an activation energy sufficient to cause dissociation of the background ions to an extent greater than that of the ions of interest. Preferably, the ions of interest are not detectably dissociated or fragmented at all. Thus, the preferred dissociation of the background ions causes the formation of "daughter" fragments of the background ions that have mass-to-charge ratios that fall outside of the selected range of mass-to-charge ratios.

The activation energy is provided by heating the ions. The ions may be heated by any method known in the art. For example, the ions may be heated by means of a static electric field or electromagnetic radiation.

The frequency of electromagnetic radiation may be any frequency that provides an appropriate amount of activation energy to the ions. For example, the frequency may be in the radiofrequency, infrared, visible, or ultraviolet range. The radiation may be provided by a laser.

The duration of the exposure of the ions to the activation energy depends upon the specific method used to heat the ions and the amount of energy required to cause dissociation of the background ions, while not causing dissociation of the ions of interest. The duration may be as short as approximately 1 picosecond, especially with the use of a laser, 1 microsecond, or 1 millesecond. The duration may be as long as approximately 1 second, 10 seconds, or 1 minute. The duration will usually not be more than approximately 10 minutes.

The ions of interest are separated according to their respective mass-to-charge ratios, and detected. Methods for separating and detecting ions are achieved in mass spectrometric analyzers, as are well known in the art. See below.

In another embodiment, the invention relates to a mass spectrometer capable of carrying out the method described above. Referring now to FIG. 1, a schematic representation of a mass spectrometer in accordance with the present invention is shown. The mass spectrometer includes a source of ions, a transport means, a mass-to-charge analyzer, and a means for subjecting ions to an activation energy, i.e. an activation energy unit. With the exception of the activation energy means and unit, the structure of the mass spectrometer is well known and could include any mass spectrometer known to those skilled in the art.

The source of ions can be any source that produces ions in a mass spectrometer. The source may be a pulsed or non-pulsed source. Some suitable sources include matrix-assisted laser desorption ionization (MALDI), electrospray ionization (ESI) sources, ion bombardment, fast atom bombardment (FAB), and atmospheric pressure chemical ionization (APCI).

The mass-to-charge analyzer can be any type of analyzer that separates ions in accordance with their m/z ratios, and detects the ions. Suitable analyzers are well known in the art. The analyzer may, for example, be a time-of-flight analyzer. Alternatively, the mass analyzer may comprise an ion trap. Other analyzers that may be used include the triple quadrupole mass analyzer, the quadrupole—quadrupole time-of-flight analyzer, the Fourier transform ion cyclotron resonance analyzer, multiple stage magnetic/electric deflection analyzers, and hybrid instruments that combine the mass spectrometers listed above.

The transport means is generally any structure used in mass spectroscopy for transporting ions from the source of ions to the analyzer. The transport means may, for example, comprise an electric field, a magnetic field, or a combination thereof.

Preferably the transport structure comprises a multipole. Some suitable multipoles include a quadrupole, an octapole or a combination thereof. A preferred transport device comprises an octapole situated between a quadrupole and the analyzer, especially between a quadrupole and an ion trap.

The activation energy unit is shown schematically to extend through and between the components of a mass spectrometer, i.e., the ion source, the transport structure, and the analyzer, to represent that its physical location in a mass spectrometer is not critical to the invention. The activation energy unit may be located inside or outside any one or more of the components, or between any of the components. The activation energy unit is configured to subject the ions generated by the source of ions to an activation energy prior to their detection by the analyzer.

The activation energy unit preferably subjects the ions of interest and the background ions to the activation energy by heating the ions. The activation energy unit may, for example, comprise a source of a static electric field, or a source of an electromagnetic field. The frequency of the electromagnetic radiation may, for example, be in the radiofrequency, infrared, visible, or ultraviolet range.

The radiation may be provided by any suitable source. For example, infrared radiation may be provided by a hot wire, or by heating the housing of one or more of the elements of the mass spectrometer, i.e. the ion source, the mass analyzer, or the structure for transporting the ions.

Radiofrequency, infrared, visible, or ultraviolet radiation may be provided by a lamp that emits the appropriate frequency. The radiation may be introduced through a window in one of the elements of the mass spectrum, or by means of fiber optics technology. The source of radiation may, for example, be a laser.

The radiation may be used to directly activate the background ions. Alternatively, the radiation may be used to accelerate the ions and cause them to collide with neutral gas molecules, wherein these collisions cause the background ions to become activated.

Mass spectrometers suitable for practicing the invention are well known in the art. Some suitable examples of mass spectrometers include those disclosed in Krutchinsky, A. N.; Zhang, W.; Chait, B. T. *J Am Soc Mass Spectrom* 2000, 11, 493–504; Krutchinsky, A. N.; Kalkum, M.; Chait, B. T. "Rapid, Automatic Identification of proteins With a Novel MALDI-Ion Trap Mass Spectrometer." (accepted for publication in *Anal. Chem.*); and U.S. patent application Ser. No. 09/835,943 filed on Apr. 16, 2001, all of which are incorporated herein by reference. Other types of mass spectrometers include triple quadrupole mass spectrometers and Fourier transform ion cyclotron resonance mass spectrometers.

The remainder of the discussion focuses on the results obtained using the MALDI-ion trap mass spectrometer disclosed in U.S. patent application Ser. No. 09/835,943 filed on Apr. 16, 2001. It is understood, however, that those skilled in the art could adapt the description below to any other type of mass spectrometer.

EXAMPLE

Figure 2:
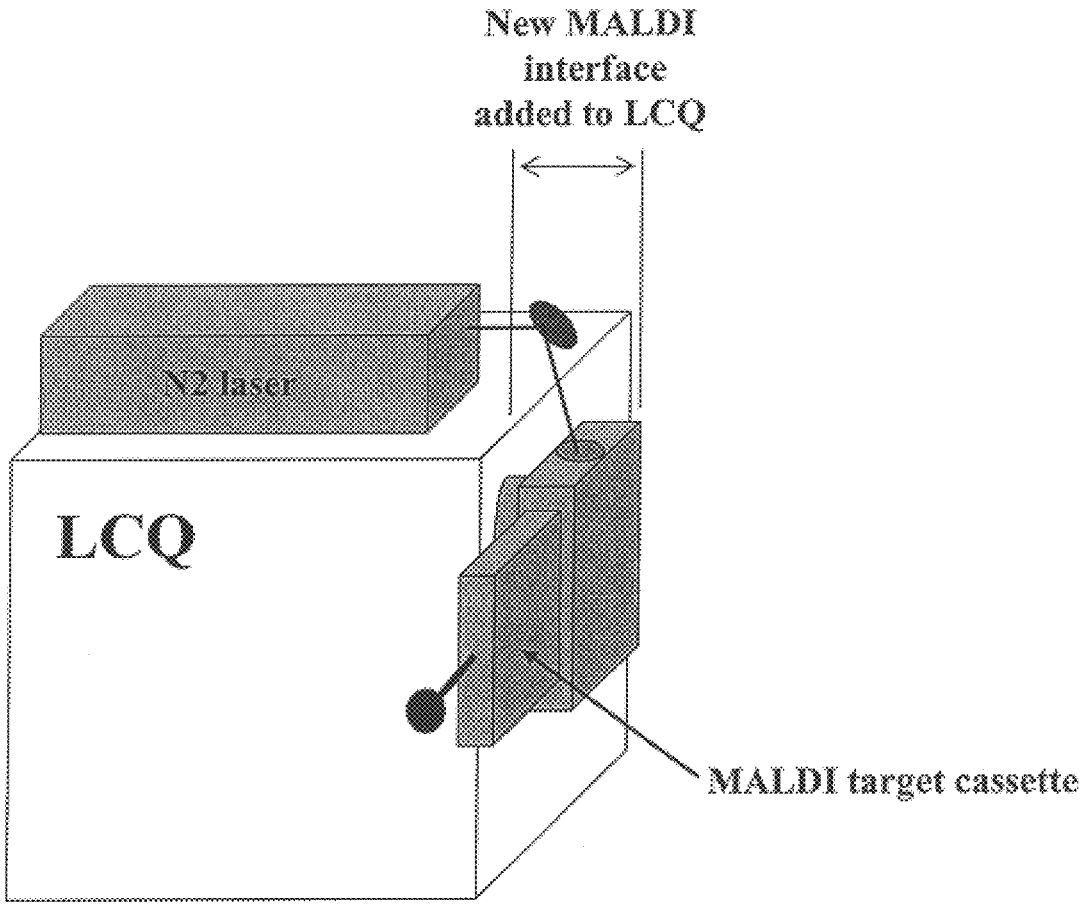
FIG. 2 is a schematic diagram of the MALDI-ion trap mass spectrometer used to obtain the present results showing the commercial Finnigan LCQ mass analyzer unshaded and the added MALDI ion source and interface shaded.

The inventors modified a commercial ion trap (IT) mass spectrometer (Thermo Finnegan LCQ Classic) and installed a new ion interface, which enabled high performance operation in both MALDI and/or ESI modes. The results obtained with a version of the instrument that operates exclusively in the MALDI mode as shown in FIG. 2 is described below.

Figure 3:
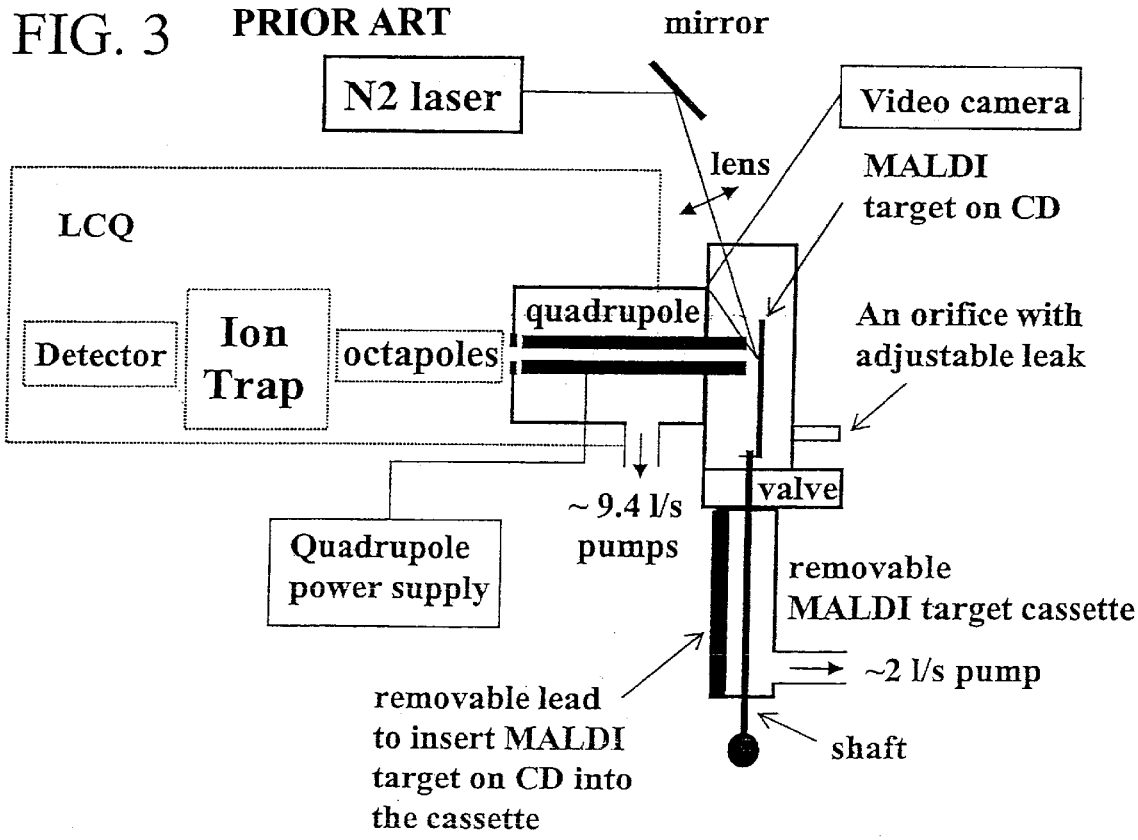
FIG. 3 PRIOR ART
FIG. 3 is schematic diagram of the quadrupole ion guide of the MALDI-ion trap mass spectrometer.
Figure 4:
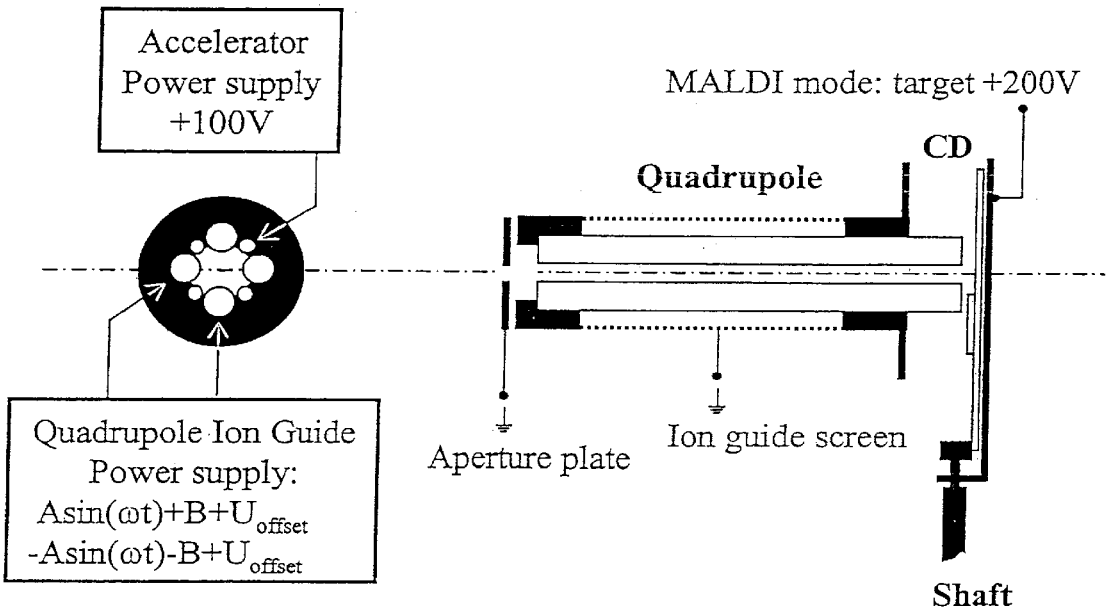
FIG. 4 PRIOR ART
FIG. 4 illustrates the voltages applied to the different components of the quadrupole ion guide of the MALDI-ion trap mass spectrometer.

FIGS. 3 and 4 show a schematic diagram of the mass spectrometer, where the added MALDI ion source and new interface is illustrated by solid lines in FIG. 3. The interface consists of a quadrupole (~20 cm long, 0.635 cm rod diameter) installed between the octapoles and the skimmer in the original commercial configuration. The quadrupole is separated from the octapoles by an aperture plate (aperture diameter ~0.3 cm). FIG. 4 provides a detailed view of the quadrupole construction and the voltages applied to the different components. The additional quadrupole acts as a high pressure ion guide Douglas, D. J.; French J. B. Collisional focusing effects in radiofrequency quadrupoles. *J Am. Soc. Mass Spectrom.* 1992, 3, 398–408; Xu, H. J.; Wada, M.; Tanaka, J.; Kawakami, H.; Katayama, I. A new cooling and focusing device for ion guide. *Nucl. Instrum. Methods Phys. Res., Sect. A* 1993, 333(2–3), 274–281; Krutchinsky, A. N.; Chernushevich, I. V.; Spicer, V. L.; Ens, W.; Standing, K. G. Collisional damping device for an electrospray ionization time-of-flight mass spectrometer. *J. Am. Soc. Mass Spectrom*

1998, 9(6), 569–579. The quadrupole is driven by an independent RF power supply, which consists of a 500 kHz crystal oscillator-controlled sine wave generator and a power amplifier (model 240L ENI, Rochester, N.Y.), which produces an RF voltage with the typical value of the sine wave amplitude A=+[300–500] V.

The ion guide assembly also contains an accelerator, which provides an electrical force to drag the ions towards the exit of the ion guide. The accelerator consists of a set of four ~18 cm long rods 0.32 cm in diameter inserted between the main rods of a quadrupole ion guide as shown in the cross sectional view in FIG. 4. The accelerator rods are closer to the axis of the quadrupole ion guide at its entrance and further from the axis at the ion guide output. A constant voltage (typically +100V) applied to all four rods of the accelerator creates a small electrical field along the axis of the quadrupole ion guide because of the changing proximity of these rods to the axis of the ion guide. Its presence in the construction improves the transport efficiency of ions. Chalmers, M. J.; Gaskell, S. J. Advances in mass spectrometry for proteome analysis. *Curr. Opin. Biotechnol.* 2000, 11, 384–390.

The pressure in the quadrupole ion guide of 70±10 mTorr is controlled by the ratio of the rate of flow of gas introduced from a small orifice with an adjustable leak as shown in FIG. 3 and the pumping speed of the mechanical pump (Pfeifer UNO 030B, ~8 l/s) originally installed in the instrument. This pump also evacuates a turbomolecular pump supplied with the original instrument, which maintains the pressure in the detector region at ~2*10–5 Torr.

MALDI samples are deposited on the surface of a compact disc (CD), which serves as a MALDI target. The major characteristics of the polycarbonate MALDI target have been previously reported by the inventors in articles cited above. The target is made using a blank CD, which are prepared from standard CDs (74 min 650 mb, Silver/Blue, 1–12× Certified CD-R, Cyanine Blue Dye). First, the metal layer that covers the CD on one side is removed by making a small scratch in the metal layer and then carefully removing it with sticky tape. The freshly exposed layer of dye is then washed with methanol and then water. A paper label is then glued to this cleaned side. Labels are designed using the FreeHand8 or LabView computer programs and contains up to 1000 labeled positions patterned on circles or a spiral. Samples are deposited along the labeled positions on the opposite side, i.e., on the CD polycarbonate surface. The labels can be easily read because the CD is transparent.

The added section as shown in FIG. 3 has a sample inlet system that allows rapid (1–2 min) introduction of the CD MALDI target through a vacuum lock. The CD with samples spotted on its surface is fixed with a screw to a metal CD support plate and introduced into the mass spectrometer. A MALDI target potential is applied to the plate when it makes a physical contact with a spring electrode as shown in FIG. 4. The distance between the CD and the entrance of the ion guide is ~1 mm. Each sample on the CD is positioned at the entrance of the quadrupole ion guide by rotating and translating a shaft attached to the CD supporting plate. Rotation of the shaft is transmitted to the CD through a small rubber wheel at the end of the shaft.

A 337 nm wavelength laser beam (VSL-337 nitrogen laser, Laser Science Inc., MA) operating at a repetition rate of 10–20 Hz is reflected by a mirror and introduced through a collimating lens (f=15 cm) and then through a sapphire window to the surface of the CD at an angle of incidence of ~60°. The diameter of the laser spot on the sample surface is ~0.3–0.5 mm. The power density of laser radiation in the spot is (2–5)×$10^7$ W/$cm^2$, controlled by a variable attenuator (Model 935-5, Newport Co, CA). Both the sample and the laser spot are monitored by a video camera. Desorbed ions are introduced directly into the quadrupole ion guide.

A calibration stock mixture consisting of six peptides (bradykinin, fragment 2–9, (monoisotopic mass 903.5 Da), Substance P (1346.7 Da), neurotensin (1671.9 Da), amyloid β-protein fragment 12–28 (1954.0 Da), ACTH fragment 1–24 (2931.6 Da), insulin chain B, oxidized from bovine insulin (3493.6 Da) was prepared at a concentration of 200 fmol/μl per component in water/methanol/acetic acid (60/35/5 v/v/v). Fresh saturated solutions of 2,5-dihydrobenzoic acid (DHB, MW 155.1), α-cyano-4-hydroxycinnamic acid (4HCCA, MW 189.2) and 3,5-dimethoxy-4-hydroxycinnamic acid (SA, MW 224.2) matrices (Aldrich) were prepared in MeOH/$H_2O$/Acetic Acid (60/35/5 v/v/v) just prior to measurements. To prepare samples for MS analysis, a volume of the diluted peptide mixture was mixed with an equal volume of the saturated DHB solution and 1 μl of the resulting solution was spotted on the CD sample plate.

The mass spectrometer used was a Thermo Finnegan LCQ Classic mass spectrometer modified to accomodate a MALDI ion source. All spectra were obtained at the following settings on the instrument (using the standard Finnegan notation): ion injection time 500 ms ("Maximum Inject Time"), automatic gain control (AGC) on, maximum number of ions allowed to fill the trap 5*$10^9$ ("Full MS Target"). In addition, MS/MS spectra were obtained with the following settings: m/z window was 3–4 ("Isolation Width"), activation energy was 25% ("Normalized Collision Energy"), q of activation was 0.25 ("Activation q") and activation time was 300 ms ("Activation Time").

Figure 5:
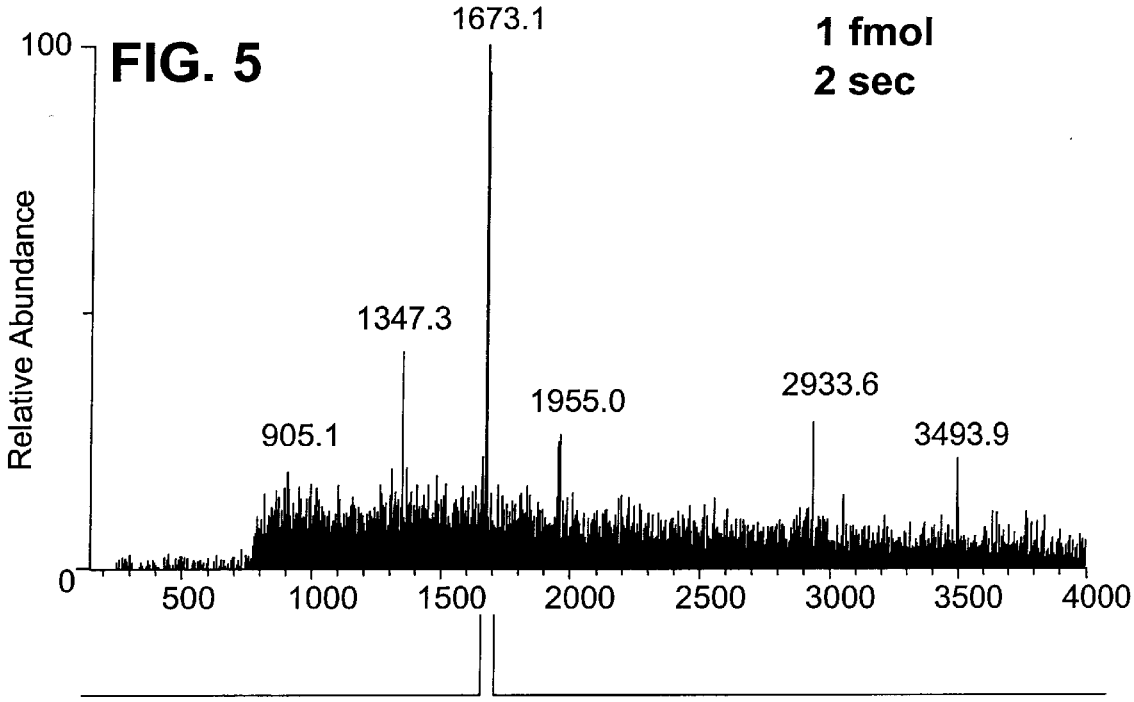
FIG. 5 is a MALDI mass spectrum of 1 fmol each of a mixture of six peptides, bradykinin fragment 2–9 (monoisotopic mass 903.5 Da), substance P (1346.7 Da), neurotensin (1671.9 Da), amyloid β-protein fragment 12–28 (1954.0 Da), ACTH fragment 1–24 (2931.6 Da), insulin chain B, oxidized, from bovine insulin (3493.6 Da). Spectrum acquisition time was 2 sec.
Figure 7:
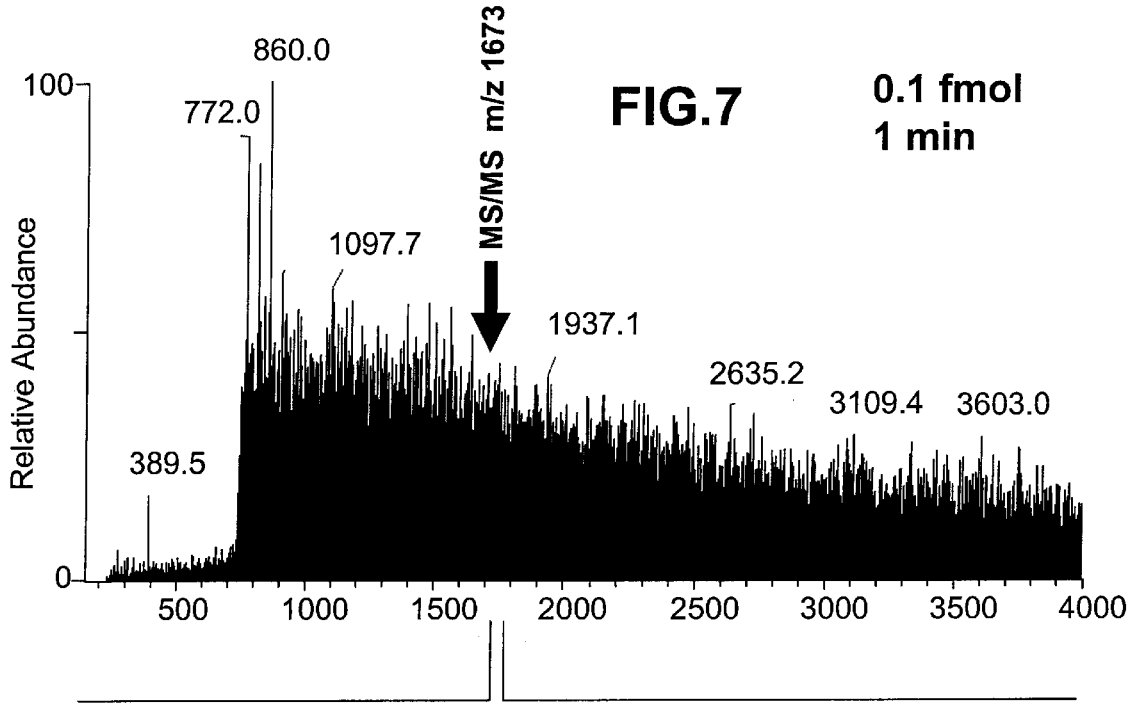
FIG. 7 is a MALDI mass spectrum of the same six peptide mixture noted in the description to FIG. 5 except that here the amount of each peptide applied to the CD target was 0.1 fmol. Acquisition time was 1 min.

The present MALDI-ion trap mass spectrometer reproducibly produces high quality MS and MS/MS spectra from low femtomole amounts of peptide mixtures. An important feature of the new instrument is its ability to perform high speed analyses. FIG. 5 shows an example of a MALDI-ion trap mass spectrum obtained from the six peptide mixture, where 1 fmol of each component was deposited on the MALDI target. The spectrum was acquired in 2 sec. Signals from five of the six components can be readily discerned above the noise. The bottom panel of the same figure shows the MS/MS spectrum of the single peptide component at m/z 1673. A useful signal-to-noise ratio was obtained in a 5 second acquisition. However, when we further diluted the sample by factor 10 and applied the resulting 0.1 fmol of the peptide mixture to the MALDI target, we were no longer able to discern the peptide ion signals, even when the acquisition time was increased to 1 min (FIG. 7). The persistent signal from the background ions interferes with the observation of the ion signals from the peptides. This is a typical situation frequently encountered in the analysis of small amounts of sample. The detection limit varies from instrument to instrument, but in general depends on sample handling and preparation procedures as well as on particular characteristics of the mass spectrometer—e.g., the resolution and the type of ion detector.

Figure 6:
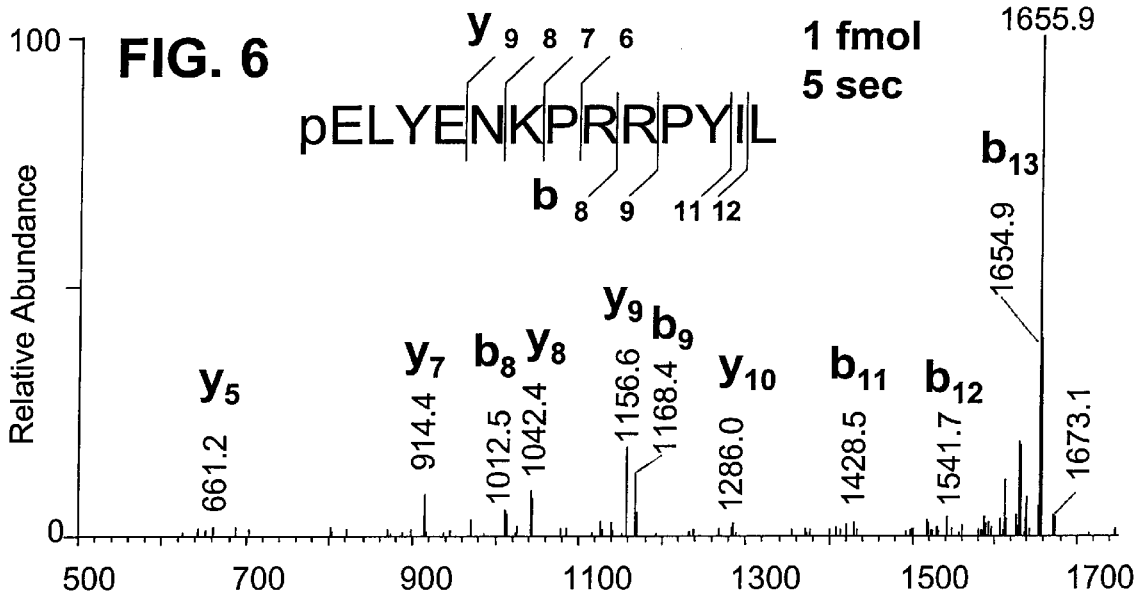
FIG. 6 is a MALDI-MS/MS spectrum of the neurotensin ion species observed at m/z 1673.1 selected from the spectrum shown in FIG. 5 with the sequence of neurotensin and the corresponding observed fragments shown. Spectrum acquisition time was 5 sec.
Figure 8:
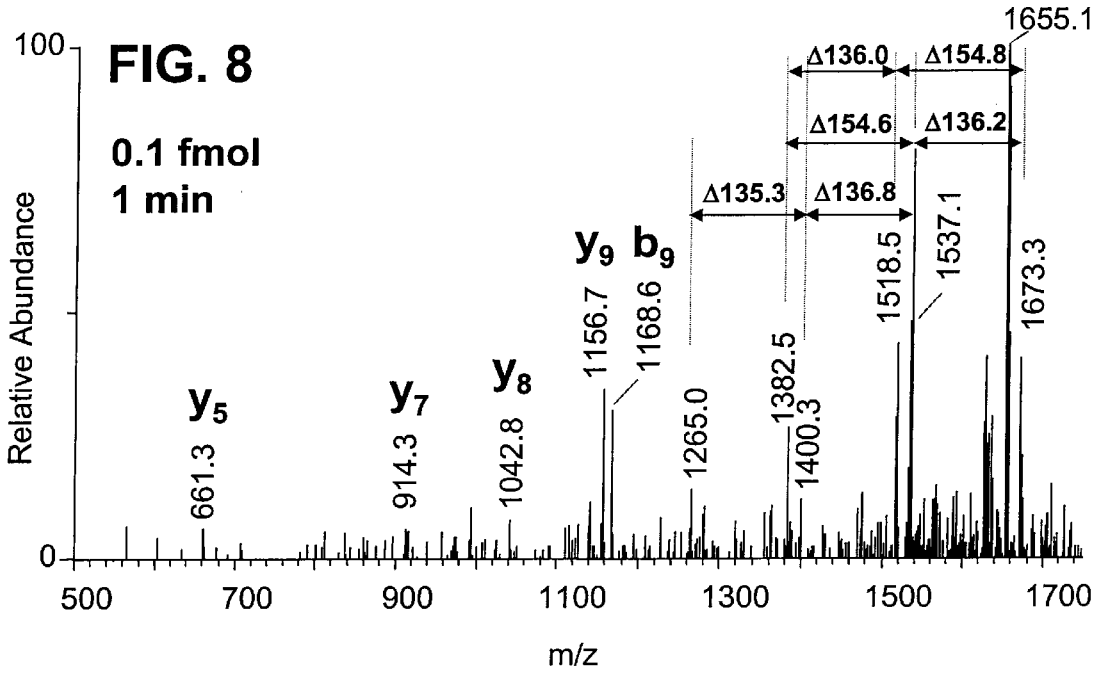
FIG. 8 is a MALDI-MS/MS mass spectrum of the species at m/z 1673 with observed fragments corresponding to neurotensin (see sequence in FIGS. 5 and 6) labeled. Evident are a series of fragments arising due to the losses of DHB matrix molecules and distanced by 154 Da and 136 Da from the parent ions at m/z 1673. Spectrum acquisition time was 1 min.
Figure 9:
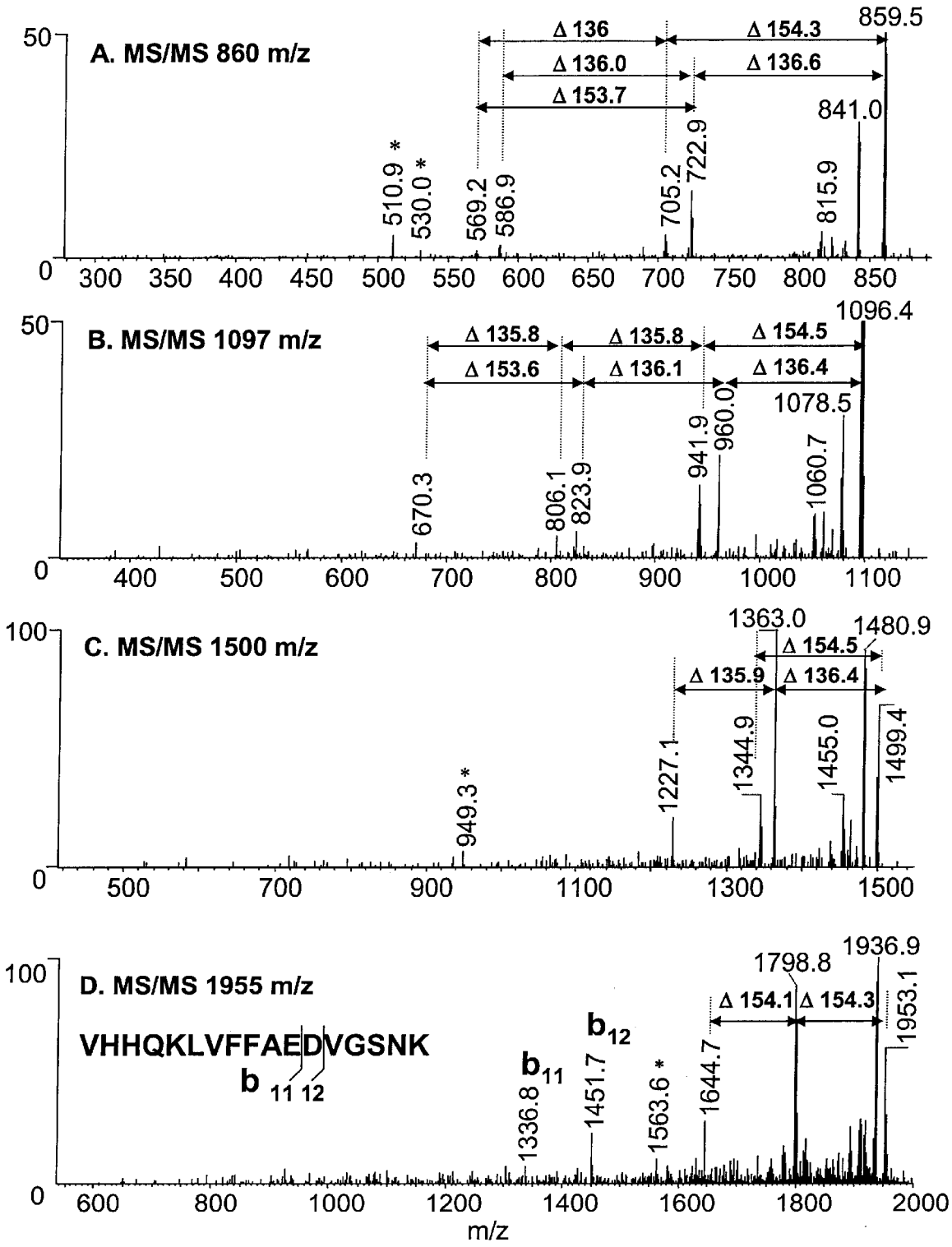
FIG. 9 is a MALDI-MS/MS mass spectra obtained from a selection of m/z values in FIG. 7, including m/z values (860, 1097, 1500) where no peptide signals are expected as well as one m/z value (1955) where a peptide signal is expected. Characteristic losses of intact molecules of DHB (154 Da) and molecules of DHB with eliminated water (136 Da) from the parent species are indicated. The * indicates unexplained ion peaks.

Despite the absence of discernable peptide ion signals at 0.1 fmol in the MS spectrum, we were able to obtain a diagnostic MS/MS spectrum of the species at m/z 1673 in an acquisition period of 1 min (FIGS. 7 and 8). Although the MS/MS spectrum is noisy, abundant fragments of the peptide can be clearly observed in the spectrum (compare FIGS. 8 and 6). These diagnostic fragments arise from selective fragmentation of the singly charged peptide ions at a few characteristic places along the peptide backbone, namely on the N-terminal side of proline residues ($b_9$, $y_7$) and the C-terminal side of the glutamic acid residue ($y_9$). Another striking feature of the MS/MS spectrum is a series of fragments distanced by ~154 Da and ~136 Da from the parent ion. We hypothesized that this series arises from the fragmentation of clusters containing intact and fragmented matrix molecules formed during the MALDI plume expansion and ionization process. The molecular mass of DHB is 154.1 Da, while elimination of a water molecule would yield an entity of molecular mass 136.1 Da. The spectrum in FIG. 8 exhibits a series of characteristic losses that is consistent with successive loss of either intact DHB molecules or its fragments from the parent ion species selected at m/z 1673. Supporting evidence in favor of this hypothesis was the observation of essentially the same set of characteristic losses in the MS/MS spectra at every m/z value tested. FIG. 9 shows a representative subset of such MS/MS spectra. Thus, we conclude that these cluster ions have a composition $(DHB)_nXH^+$, where X represents presently unknown species.

We were unable to determine the exact composition (including the identities of X) of these cluster species via $MS^n$ experiments because of the increasing number of dissociation channels that open up as a function of the order of $MS^n$ experiment, the low absolute intensity of the chemical noise produced from our MALDI samples on the polycarbonate CD surface, and the complex mix of ion species that are present at each nominal m/z value. We also investigated the use of several alternative MALDI matrices including α-cyano-4-hydroxycinnamic acid (4HCCA) and 3,5-dimethoxy-4-hydroxycinnamic acid (SA). MALDI mass spectra of the six peptide mixture demonstrated that these matrices were inferior to DHB in conditions optimized for our MALDI-IT mass spectrometer—the peptide ion signals were less intense, the shot-to-shot reproducibility was lower, and the noise level higher. The likely reason for this inferior behavior is the "hotter" nature of 4HCCA and SA compared with DHB. The spectra from 4HCCA and SA also showed characteristic losses evidencing the cluster nature of the background from these matrices.

Figure 10:
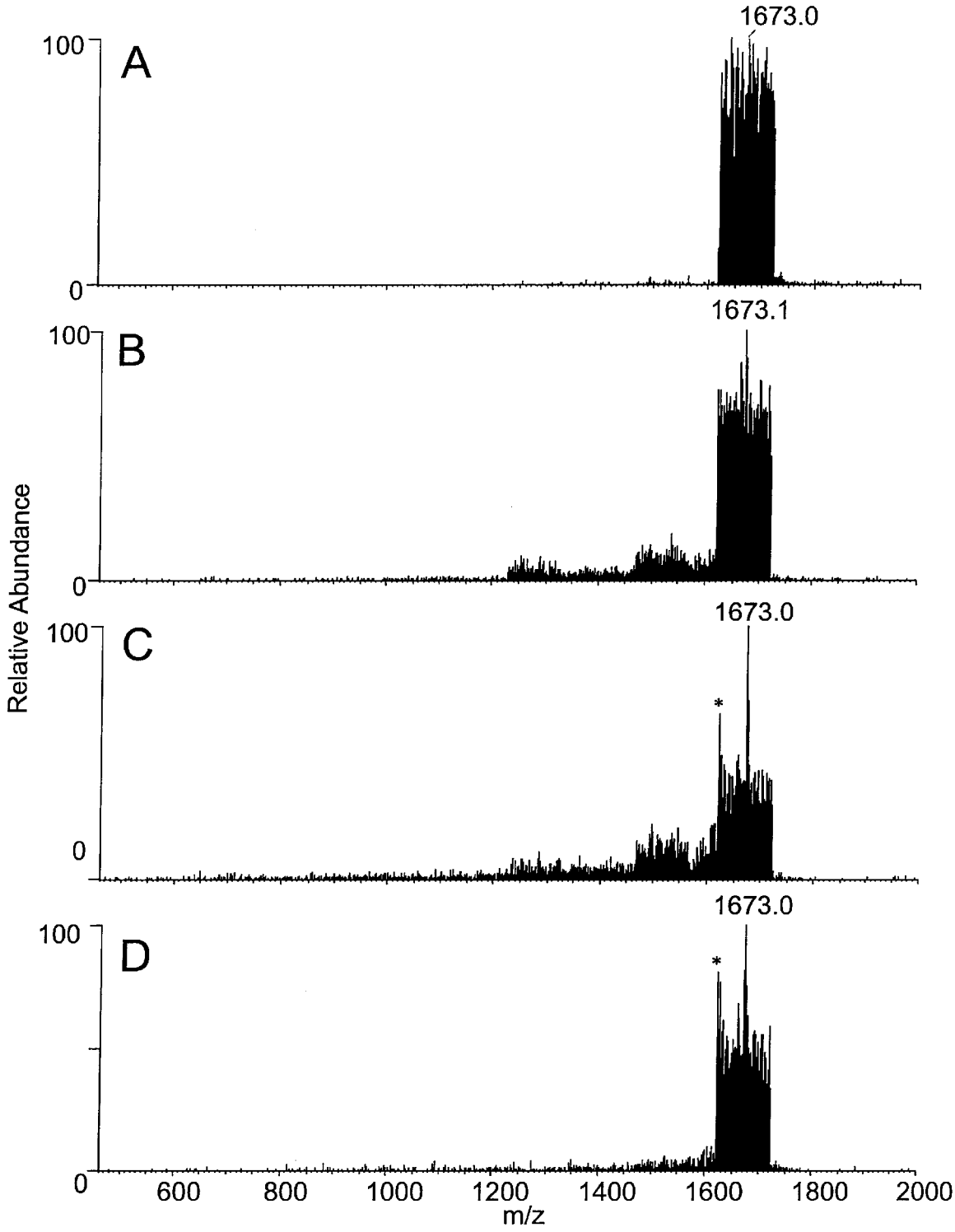
FIG. 10 is a MALDI spectrum of the species from the 0.1 fmol peptide mixture obtained in a 100 m/z unit wide window centered on m/z 1673 with (A) no collisional activation applied to the selected ions in the window; (B) mild collisional activation of the species in the selected window (i.e., performed at a "normalized collision energy" of 15% for a period of 300 ms); (C) stronger collisional activation of the species in the selected window (i.e., performed at a "normalized collision energy" of 20% for a period of 300 ms). (D) shows the result of a double collisional activation experiment. Here, the selected species were activated at 20% of the "normalized collision energy" for 300 ms. The species that were not removed from the selected m/z window during the first activation experiment were selected again and activated once more at 20% of the "normalized collision energy" for 300 ms. * designates an artifact "peak" that appears at the edge of the selection window.

Our finding that DHB clusters readily undergo collision-induced dissociation was used to observe weak ion signals in the presence of the chemical noise. The technique is demonstrated in FIG. 10 where we carried out "broadband" collisional activation of part of the mass spectrum in FIG. 8 centered on m/z 1673. Activation was performed over a window with width±50 m/z units. The top panel shows this selection window with no activation applied to the selected ions. Under these conditions, we observe the same chemical noise background in the selected portion of the spectrum as observed in FIG. 8, with no discernable peptide signal. However, after modest activation of the ion species in the selected window, we observe dissociation of ions within the window, and the peptide ion at m/z 1673 begins to emerge from the noise (FIG. 10B). It is of note to observe that the center of the distribution arising from fragmentation of the species in the selected window is shifted by ~150 m/z units, which likely corresponds to the loss of a DHB molecule from each of the cluster species in the window. When we further increase the activation energy to the threshold for fragmentation of the peptide ion, the peptide ion peak becomes clearly apparent (FIG. 10C). Further increases of the excitation did not produce any further improvement in the signal-to-noise ratio in the selected window; but rather increased the fragmentation of the peptide ions at m/z 1673. The lower panel of FIG. 10 shows a $MS^3$ experiment. Ions in the selected window were excited under the same conditions used in FIG. 10C, whereupon the remaining stable species were re-isolated and subjected to a second excitation under the same conditions used in FIG. 10C. Very little further dissociation of the residual background is observed, demonstrating that these remaining background ions are stable to dissociation at excitations close to the threshold for peptide dissociation. Thus, there is a relatively stable component of the chemical noise background that is resistant to dissociation. We conclude from this experiment that collisional activation of ion species in the selected window allow us to remove at least half of the chemical noise background species, resulting in the clear observation of the peptide signal with a signal-to-noise ratio ~3:1.

Figure 11:
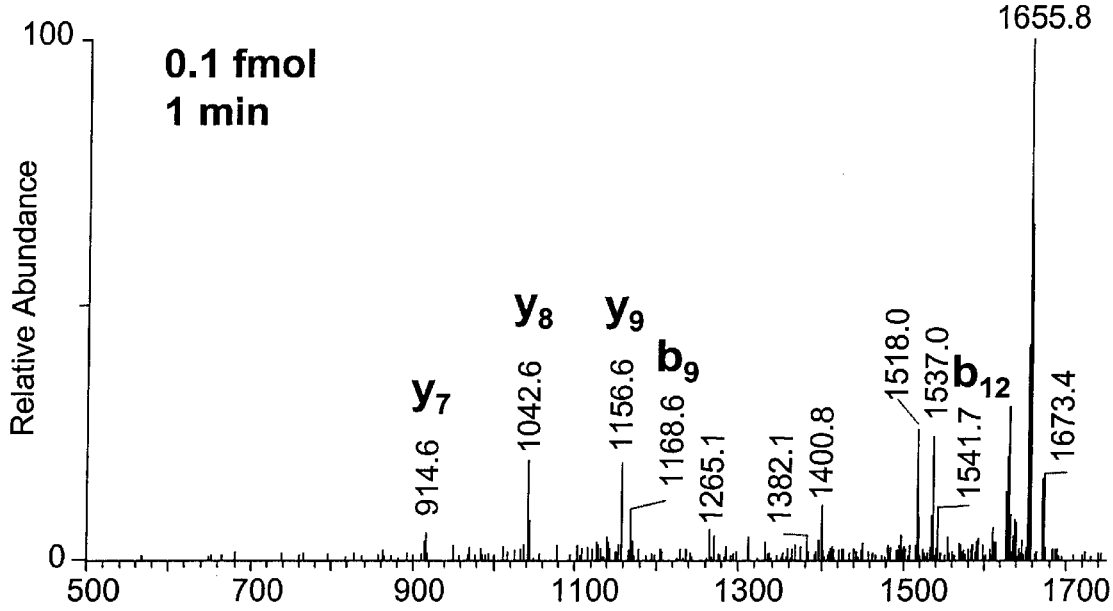
FIG. 11 is a MALDI-$MS^3$ spectrum obtained from 0.1 fmol of the peptide at m/z 1673 where during the MS stage of the experiment, the ions were activated at a "normalized collision energy" of 20% for 300 ms to remove the background cluster species that readily undergo fragmentation under these collisional activation conditions. During the subsequent $MS^3$ stage of the experiment, the energy was increased to 25% to obtain fragmentation of the peptide ions.

To test the utility of the above-described noise reduction procedure, we again obtained a fragmentation spectrum of the peptide at m/z 1673 from the 0.1 fmol peptide mixture sample. However, this time we performed an $MS^3$ experiment in which we first activated ions at the same energy as that used to obtain FIG. 6C causing dissociation of the more fragile components of the chemical noise background, and then increased the activation energy to 25% so as to fragment the peptide. The $MS^3$ fragmentation spectrum of the peptide is shown in FIG. 11. As expected, the background fragmentation due to noise in this spectrum is lower than that in the corresponding $MS^2$ spectrum (FIG. 8).

One of the major obstacles in obtaining useful MALDI-MS and MS/MS spectra from low femtomole to subfemtomole amounts of peptides is interference from the "chemical noise." This "chemical noise" is produced during the desorption and ionization of peptides, matrix and impurities in the sample. Unwanted impurities can be removed to some extent by commonsense methods—e.g., by using highly purified reagents, careful desalting procedures, and clean MALDI substrates. Thus, we found that the polycarbonate surface used in the fabrication of CDs produces by far the lowest background in MALDI spectra of the various (~20) surfaces that we have tested.

An even more challenging problem is the removal of the "chemical noise" arising from matrix ions. Analysis of MS/MS spectra obtained from weak peaks and background in the MS spectrum revealed the presence of matrix cluster ions at practically every m/z value. These cluster species produce a characteristic fragmentation pattern that arises from sequential loss of intact matrix molecules and matrix fragments. In particular, a significant proportion of the clusters of DHB were found to fragment readily at activation energies lower than that used to fragment peptide ions. This phenomenon was used to pre-activate and break up those matrix clusters that fragment more readily than peptides. Such activation occurs to some extent upon ion injection in the ion trap even prior to ion manipulation in the ion trap. Indeed, we have observed that MALDI-MS spectra obtained in an ion trap operating in the "extended m/z range mode" (i.e., m/z 450–4000) are less noisy than spectra obtained in the "normal m/z range mode" (i.e., m/z 150–2000). This observation can be rationalized by the deeper effective potential well in the trap operating in extended m/z range and hence the higher potential energy of ions entering the ion trap.

Another method to pre-activate ions is to perform MS/MS experiment over a wide m/z window. By selecting the pre-activation energy to be lower than the threshold energy for peptide fragmentation, we have demonstrated that we can improve the signal-to-noise in the selected m/z window. Current settings in the commercial MALDI-IT permit pre-activate ions of 100 m/z units.

The pre-activation of ions may also be achieved external to the ion trap. This is readily achievable in the high pressure collisional ion guide. For example, ions are readily pre-activated during use of the ion guide as a narrow m/z range filter, where the selected ions are excited because of proximity to the boundaries of stability. Alternative means for pre-heating the ions are to inject them at higher energy into the ion guide or excite them with "white noise" applied to the RF drive signal.

Thus, while there have been described what are presently believed to be the preferred embodiments of the invention, those skilled in the art will realize that changes and modifications may be made thereto without departing from the spirit of the invention, and is intended to claim all such changes and modifications as fall within the true scope of the invention.

What is claimed is:

1. A method for increasing the signal-to-noise ratio in a range of mass-to-charge ratios of a mass spectrum, the method comprising:

generating ions of interest and background ions having mass-to-charge ratios within the range of mass-to-charge ratios;

subjecting the ions of interest and the background ions to an activation energy sufficient to cause dissociation of background ions to an extent greater than the dissociation of the ions of interest, wherein dissociation of the background ions causes the background ions to have mass-to-charge ratios that fall outside of the range of mass-to-charge ratios; and detecting the mass-to-charge ratios of the ions of interest.

2. A method according to claim 1, wherein the noise is chemical noise.

3. A method according to claim 1, wherein the background ions are held together by non-covalent bonds.

4. A method according to claim 1, wherein the background ions comprise at least one of 2,5-dihydrobenzoic acid, cyano-4-hydroxycinnamic acid, or 3,5-dimethoxy-4-hydroxycinamic acid.

5. A method according to claim 1, wherein the background ions comprise at least one of water, acetic acid, trifluoroacetic acid, formic acid, methanol, and acetonitrile.

6. A method according to claim 1, wherein the range of mass-to-charge ratios is a minimum of about 1 and a maximum of about 100,000.

7. A method according to claim 6, wherein the range of mass-to-charge ratios is a minimum of about 50 and a maximum of about 100.

8. A method according to claim 1, wherein the ions of interest are peptide ions.

9. A method according to claim 1, wherein the ions of interest and the background ions are subjected to the activation energy by heating the ions.

10. A method according to claim 9, wherein heating the ions is provided by subjecting the ions of interest and the background ions to a static electric field.

11. A method according to claim 9, wherein heating the ions is provided by electromagnetic radiation.

12. A method according to claim 11, wherein the electromagnetic radiation is provided by a radio frequency field.

13. A method according to claim 11, wherein the electromagnetic radiation is ultraviolet or infrared radiation.

14. A method according to claim 11, wherein the electromagnetic radiation is provided by a laser.

15. A method according to claim 1, wherein the ions of interest and the background ions are subjected to the activation energy for at least about 1 picosecond.

16. A method according to claim 1, wherein the ions of interest and the background ions are subjected to the activation energy for no more than about 10 minutes.

17. In a mass spectrometer (i) that comprises a source of ions of interest and background ions, a mass-to-charge analyzer, and a means to transport the ions from the source to the analyzer; and (ii) that produces a mass spectrum of signals representing the ions of interest and the background ions in a selected range of mass-to-charge ratios:

the improvement wherein the mass spectrometer further comprises a means to subject the ions of interest and the background ions to an activation energy sufficient to cause dissociation of background ions to an extent greater than the dissociation of the ions of interest, wherein dissociation of the background ions causes the background ions to have mass-to-charge ratios that fall outside of the range of selected mass-to-charge ratios, whereby the ratio of signal-to-noise in the selected range of mass-to-charge ratios of the mass spectrometer is increased.

18. A mass spectrometer according to claim 17, wherein the source is a MALDI source.

19. A mass spectrometer according to claim 17, wherein the source is an ESI source.

20. A mass spectrometer according to claim 17, wherein the analyzer is a time-of-flight analyzer.

21. A mass spectrometer according to claim 17, wherein the analyzer comprises an ion trap.

22. A mass spectrometer according to claim 21, wherein the means to transport comprises a quadrupole.

23. A mass spectrometer according to claim 22, wherein the means to transport further comprises a octapole situated between the quadrapole and the ion trap.

24. A mass spectrometer according to claim 17, wherein the mass spectrometer is a Fourier transform ion cyclotron resonance mass spectrometer.

25. A mass spectrometer according to claim 17, wherein the mass spectrometer is a triple quadrupole mass spectrometer.

26. A mass spectrometer according to claim 17, wherein the means for subjecting the ions of interest and the background ions to the activation energy are configured to generate a radiofrequency field.

27. A mass spectrometer according to claim 17, wherein the means for subjecting the ions of interest and the background ions to the activation energy are configured to generate a static electric field.

28. A mass spectrometer according to claim 17, wherein the means for subjecting the ions of interest and the background ions to the activation energy are configured to heat the ions.

29. A mass spectrometer according to claim 28, wherein the heating is provided by electromagnetic radiation.

30. A mass spectrometer according to claim 29, wherein the electromagnetic radiation is ultraviolet or infrared radiation.

31. A mass spectrometer according to claim 29, wherein the electromagnetic radiation is provided by a laser.

32. In a mass spectrometer (i) that comprises a source of ions of interest and background ions, a mass-to-charge analyzer, and a structure for transporting the ions from the source to the analyzer; and (ii) that produces a mass spectrum of signals representing the ions of interest and the background ions in a selected range of mass-to-charge ratios:

the improvement wherein the mass spectrometer further comprises an activation energy unit to subject the ions of interest and the background ions to an activation energy sufficient to cause dissociation of background ions to an extent greater than the dissociation of the ions of interest, wherein dissociation of the background ions causes the background ions to have mass-to-charge ratios that fall outside of the range of selected mass-to-charge ratios, whereby the ratio of signal-to-noise in the selected range of mass-to-charge ratios of the mass spectrometer is increased.

33. A mass spectrometer according to claim 32, wherein the source is a MALDI source.

34. A mass spectrometer according to claim 32, wherein the source is an ESI source.

35. A mass spectrometer according to claim 32, wherein the analyzer is a time-of-flight analyzer.

36. A mass spectrometer according to claim 32, wherein the analyzer comprises an ion trap.

37. A mass spectrometer according to claim 32, wherein the structure is a multipole.

38. A mass spectrometer according to claim 37, wherein the multipole is a quadrupole.

39. A mass spectrometer according to claim 38, further comprising an octapole situated between the quadrapole and the ion trap.

40. A mass spectrometer according to claim 32, wherein the mass spectrometer is a Fourier transform ion cyclotron resonance mass spectrometer.

41. A mass spectrometer according to claim 32, wherein the mass spectrometer is a triple quadrupole mass spectrometer.

42. A mass spectrometer according to claim 32, wherein the activation energy unit is configured to generate a radio frequency field for subjecting the ions of interest and the background ions to the activation energy.

43. A mass spectrometer according to claim 32, wherein the activation energy unit is configured to generate a static electric field for subjecting the ions of interest and the background ions to the activation energy.

44. A mass spectrometer according to claim 32, wherein the activation energy unit is configured to heat the ions for subjecting the ions of interest and the background ions to the activation energy.

45. A mass spectrometer according to claim 44, wherein the heat is provided by electromagnetic radiation.

46. A mass spectrometer according to claim 45, wherein the electromagnetic radiation is ultraviolet or infrared radiation.

47. A mass spectrometer according to claim 45, wherein the electromagnetic radiation is provided by a laser.

* * * * *

UNITED STATES PATENT AND TRADEMARK OFFICE

CERTIFICATE OF CORRECTION

PATENT NO. : 6,610,976 B2 
DATED : August 26, 2003
INVENTOR(S) : Chait et al.

It is certified that error appears in the above-identified patent and that said Letters Patent is hereby corrected as shown below:

Column 3,
Line 55, now reads "the MS stage" should read -- the $MS^2$ stage --

Signed and Sealed this

Eighteenth Day of November, 2003

JAMES E. ROGAN
*Director of the United States Patent and Trademark Office*